US005906330A

United States Patent [19]

Sand

[11] Patent Number: 5,906,330

[45] **Date of Patent: *May 25, 1999**

[54] THREAD FEEDING BUFFER

[75] Inventor: Kjell Sand, Västra Frölunda, Sweden

[73] Assignee: Aplicator System AB, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,155

[22] PCT Filed: Feb. 13, 1995

[86] PCT No.: PCT/SE95/00144

§ 371 Date: Oct. 2, 1996

§ 102(e) Date: Oct. 2, 1996

[87] PCT Pub. No.: WO95/21787

PCT Pub. Date: Aug. 17, 1995

[30] Foreign Application Priority Data

Feb. 14, 1994 [SE] Sweden ..... 9400490

[51] Int. Cl.[6] ..... B65H 23/188; B65H 59/20

[52] U.S. Cl. ..... 242/419.4; 242/417; 242/419.1

[58] Field of Search ..... 242/419.4, 417, 242/419.1

[56] References Cited

U.S. PATENT DOCUMENTS

| | | | |
|---|---|---|---|
| 1,836,613 | 12/1931 | Oehmichen | 242/419.1 |
| 2,589,366 | 3/1952 | Guathier | 242/419.1 |
| 3,826,438 | 7/1974 | Stanley | 242/45 |
| 4,962,796 | 10/1990 | Grimm et al. | 139/450 |
| 5,139,206 | 8/1992 | Butler | 242/45 |

FOREIGN PATENT DOCUMENTS

| | | | |
|---|---|---|---|
| 0059833 | 9/1982 | European Pat. Off. . | |
| 0475892 | 3/1992 | European Pat. Off. . | |
| 564018 | 10/1993 | European Pat. Off. | 242/419.1 |
| 3241362 | 5/1984 | Germany | 242/419.1 |
| 4104087 | 8/1991 | Germany . | |
| 5278943 | 10/1993 | Japan | 242/419.1 |
| 1034082 | 8/1983 | U.S.S.R. | 242/419.1 |
| 930347 | 7/1963 | United Kingdom . | |
| 2117015 | 10/1983 | United Kingdom | 242/419.1 |

*Primary Examiner*—William Stryjewski

*Attorney, Agent, or Firm*—Ostrolenk, Faber, Gerb & Soffen, LLP

[57] ABSTRACT

A thread feeding buffer for feeding a fiber thread from a magazine roll to a feed apparatus. The thread feeding buffer comprises a thread brake and at least one movable thread guide, on which a thrust force is acting. The moveable thread guide is vertically shiftable and lowered by gravity. The thread runs from a magazine roll, past the brake, through the thread guide and toward a further feed guide in such a way that the thrust force acts for creation of a thread buffer between the brake and the other feed guide, which buffer is variable in length.

6 Claims, 1 Drawing Sheet

THREAD FEEDING BUFFER

FIELD OF THE INVENTION

The present invention is related to a thread feeding buffer for feeding a fibre thread from a magazine roll to a feed apparatus at a robot arm which is freely movable in the room.

BACKGROUND OF THE INVENTION

The production of fibre reinforced thermosetting plastic products can be automatized by the use of an industrial robot, by means of which a fibre feed apparatus can be controlled, so that precise amounts of fibres are fed out which are oriented for maximum strength, without the fibres projecting out through the outer plastic layer of the product.

Owing to the repeatability of the robot, the quality of these products can be increased considerably, simultaneously as problems related to bad work environment and labour fatigue can be solved.

The fibre feeding apparatus is preferably located in a feedout head which can be mounted upon a movable robot arm. One or more fibre threads are supplied to the feedout head, which cuts the threads in suitable lengths. The feeding speed of the fibre thread can be in the range of about 10 meters per second.

At such a feeding speed, it is difficult to stop the feeding of thread without any risk of getting they thread tangled.

THE TECHNICAL PROBLEM

The object of the invention is therefore to provide a thread feeding buffer which solves the above described problems.

THE SOLUTION

For this object, the invention is characterized by thread brake means and at least one movable thread guide on which a thrust force is acting, and that the thread is running from the magazine roll, via the brake means, through the thread guide and further on towards the feed apparatus in such a way, that the thrust force acts for creation of a thread buffer between the brake means and the feed apparatus, which buffer is variable in length.

BRIEF DESCRIPTION OF THE DRAWINGS

The invention will now be described in the following, with reference to an embodiment which is shown schematically on the accompanying drawing, in which.

DESCRIPTION OF PREFERRED EMBODIMENTS

Figure 2:
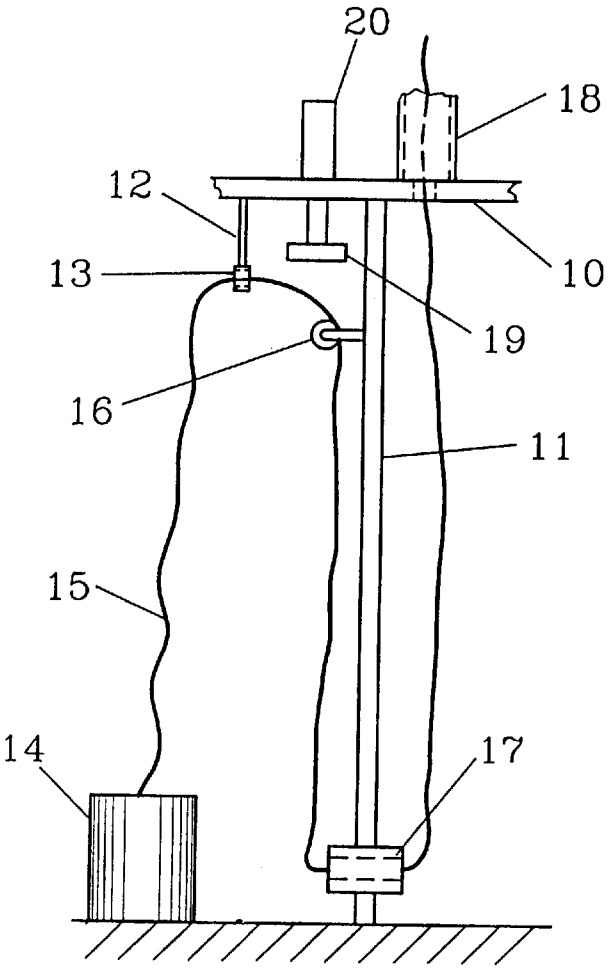
FIG. 2 shows the thread feeding buffer in FIG. 1 in a side view.
Figure 1:
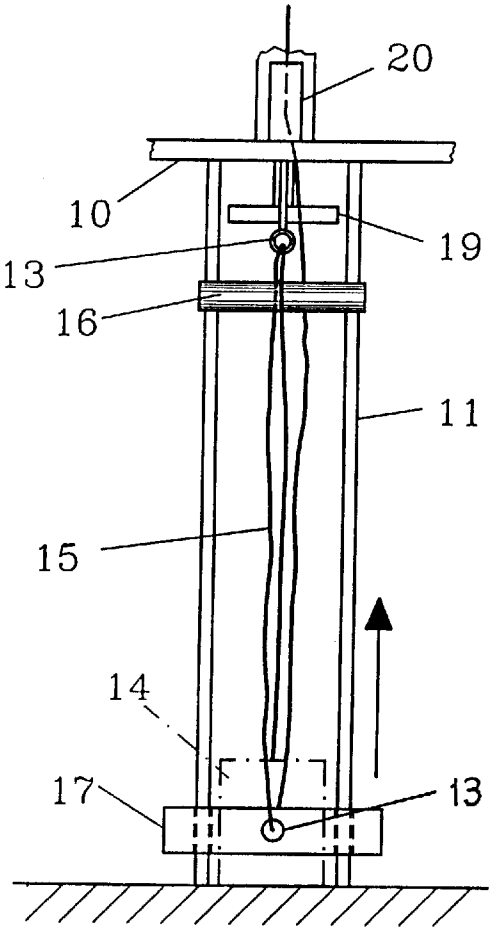
FIG. 1 is a plane view of a thread feeding buffer according to the invention.

The thread feeding buffer according to the drawing comprises a stand 10 with two vertical guide rods 11. The stand 10 carries an elbow arm 12 with a thread eyelet 13 for a thread 15 which is wound off from a roll 14. The thread can consist of a multiple fibre thread of glass, carbon fibre or synthetic fibre. The thread eyelet 13 provides for a substantially friction free passage of the thread.

The thread runs upwards from the roll 14 which is located at ground level, through the thread eyelet 13 and further over a bar 16 which changes the direction of pull back vertically down between the guide rods 11. A thread guide 17 is movably guided by the guide rods and is provided with further thread eyelets 13, through which the thread 15 runs. Then the thread runs on from the thread guide 17 in the direction upwards to a thread guide channel 18, which guides the thread further to a not shown robot arm.

A thread brake cooperates with the bar 16 and is composed of a clamp plate 19, which is mounted at the outer end of a pneumatic cylinder 20 which is connected to the stand 10. The clamp plate can be brought in or out of engagement with the bar 16 by operation of the cylinder 20, whereby the feeding of the thread will be stopped.

The thread feeding buffer operates in the following way: During normal thread feeding, the pulling of the thread, via the thread eyelets 13 and the bar 16, creates an even resistance in the thread which results in an advantageous even outfeed. If the robot arm is moving in the room, so that more or less thread has to be fed out momentarily, the thread guide 17 will be able to move up and down respectively along the guide rods, wherein the thread will receive a rapid compensation in length.

If the feeding of the thread is to be stopped, this is made by activation of pneumatic cylinder 20 which then presses the clamp plate 19 against the bar 16. Now the feeding of thread at the end of the robot arm will continue for s short moment while the thread guide 17 moves upwards along the guide rods 11, until the pull in the thread is stopped. When it will be time for restarting the feeding, this will be commenced with a correctly pretensioned thread without the risk of loops or kinks on the thread.

The invention is not limited to the above described embodiment, but several variations are possible within the frame of the accompanying claims. For example, the guide rods can be exchanged for other means for controlling a buffer of fibre thread. Further, a spring means can replace the action of gravity upon the thread guide means 17.

I claim:

1. A thread feeding buffer for a fiber thread fed from a supply and along a path comprising a first guide for the thread for receiving the thread from the supply, a contactable brake surface over which the thread is fed from the first guide; a brake element moveable into contact with the brake surface for braking movement of the thread past the brake surface;

a movable thread guide in the path of the thread past the brake surface, a support supporting the movable thread guide for movement;

a further guide following the movable thread guide in the path of the thread and past which the thread is drawn;

the support enabling the movable thread guide to be moved by the thread to reduce the length of the thread path between the brake surface and the further thread guide upon the brake element engaging the brake surface and also permitting the movable thread guide to move to lengthen the distance between the brake surface and the further thread guide to absorb slack in the thread on the path between the brake surface and the further thread guide.

2. The thread feeding buffer of claim 1, wherein the support supports the movable thread guide for movement in the vertical direction so that the movable thread guide is normally acted upon by gravity; and the first guide and the further guide are both located vertically above the movable thread guide so that the movable thread guide can move up and down to absorb slack in the thread.

3. The thread feeding buffer of claim 1, wherein the brake surface comprises a runner over which the thread runs and the brake element comprises a pneumatic cylinder and a clamp movable with respect to the cylinder for clamping against the brake surface.

4. The thread feeding buffer of claim 1, wherein the support comprises a generally vertically oriented guide rod on which the thread guide is movable.

5. The thread feeding buffer of claim 1, wherein the first guide and the movable thread guide respectively comprise eyelets through which the thread passes.

6. The thread feeding buffer of claim 1, wherein the first guide and the further guide are stationary, relative to the movement of the movable thread guide.

* * * * *